US007580759B2

(12) United States Patent
Marchon et al.

(10) Patent No.: US 7,580,759 B2
(45) Date of Patent: Aug. 25, 2009

(54) SYSTEMS AND METHODS FOR IN-SITU RECORDING HEAD BURNISHING

(75) Inventors: Bruno Marchon, Palo Alto, CA (US); Charles M. Mate, San Jose, CA (US); Bernhard E. Knigge, San Jose, CA (US); Kurt Rubin, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 176 days.

(21) Appl. No.: 11/850,304

(22) Filed: Sep. 5, 2007

(65) Prior Publication Data

US 2009/0061735 A1 Mar. 5, 2009

(51) Int. Cl.
*B24B 39/06* (2006.01)
*B24B 49/10* (2006.01)

(52) U.S. Cl. ..... 700/1; 451/11; 451/41; 29/603.03

(58) Field of Classification Search ..... 700/1; 29/603.03; 451/11, 41
See application file for complete search history.

(56) References Cited

U.S. PATENT DOCUMENTS 4,724,392 A * 2/1988 Bandara et al. ..... 324/454
5,980,369 A 11/1999 Burga et al.
6,072,313 A * 6/2000 Li et al. ..... 324/230
6,230,380 B1 5/2001 Wang et al.
6,493,184 B1 12/2002 Smith
6,503,132 B2 1/2003 Ekstrum et al.
6,707,631 B1 3/2004 Haddock
6,896,592 B2 5/2005 Smith
7,016,139 B2 * 3/2006 Baumgart et al. ..... 360/75
7,023,632 B1 4/2006 Egan et al.
7,153,193 B1 12/2006 Kurita et al.
7,193,805 B1 3/2007 Haddock
2002/0067574 A1 * 6/2002 Gillis et al. ..... 360/235.4
2006/0105676 A1 * 5/2006 O'Sullivan et al. ..... 451/5

OTHER PUBLICATIONS

Zhu Feng, Chung Shih, Vidya Gubbi and Frank Poon, A study of tribo-charge/emission at the head-disk interface, Journal of Applied Physics, vol. 85, Issue 8, Apr. 15, 1999, pp. 5615-5617.

(Continued)

*Primary Examiner*—David L Robertson
*Assistant Examiner*—Olvin Lopez
(74) *Attorney, Agent, or Firm*—Duft Bornsen & Fishman, LLP

(57) ABSTRACT

Systems and methods are provided for burnishing a recording head in-situ in a magnetic recording disk drive. The burnishing process generates a tribocurrent, which is electricity generated by the rubbing of dissimilar materials. Different materials exhibit widely different tribocurrent characteristics while in sliding contact. The tribocurrent thus acts as an indicator of the particular materials of the recording head making contact with the magnetic recording media during different stages of the burnishing process. The tribocurrent is thus monitored to determine when it reaches a threshold value. The threshold value indicates that the burnishing has exposed a particular material of the recording head. Thus, the burnishing process may be stopped upon the tribocurrent reaching the threshold value so that the read sensor of the recording head is not burnished and inadvertently damaged.

21 Claims, 5 Drawing Sheets

OTHER PUBLICATIONS

H.S. Park, J. Hwang, S.H. Choa, Tribocharge build-up and decay at a slider-disk interface, Journal Microsystem Technologies, vol. 10, No. 2, Jan. 2004, pp. 109-114.

B. Strom, S. Deits, C. Gerber, D. Krajnovich, D. Ohlsen, and R. Turner, Burnishing Heads in-Drive for Higher Density Recording, IEEE Transactions of Magnetics, vol. 40, No. 1, Jan. 2004, pp. 345-348.

Z. F. Li, C. Y. Chen, J. J. Liu, A. Chekanov, J. Geo and B. G. Demczyk, Effects of Media Burnish Capability to Head-Disk Clearance, IEEE Transactions of Magnetics, vol. 40, No. 4, Jul. 2004, pp. 3153-3155.

Youichi Kawakubo, Shunichi Miyazawa, Kosuke Kobayashi, Shinichi Kobatake, and Shinichi Nakazawa, Disk Burnishing for Head-Wear Reduction Studied by Pin-On-Disk Tests, IEEE Transactions of Magnetics, vol. 41, No. 2, Feb. 2005, pp. 802-807.

* cited by examiner

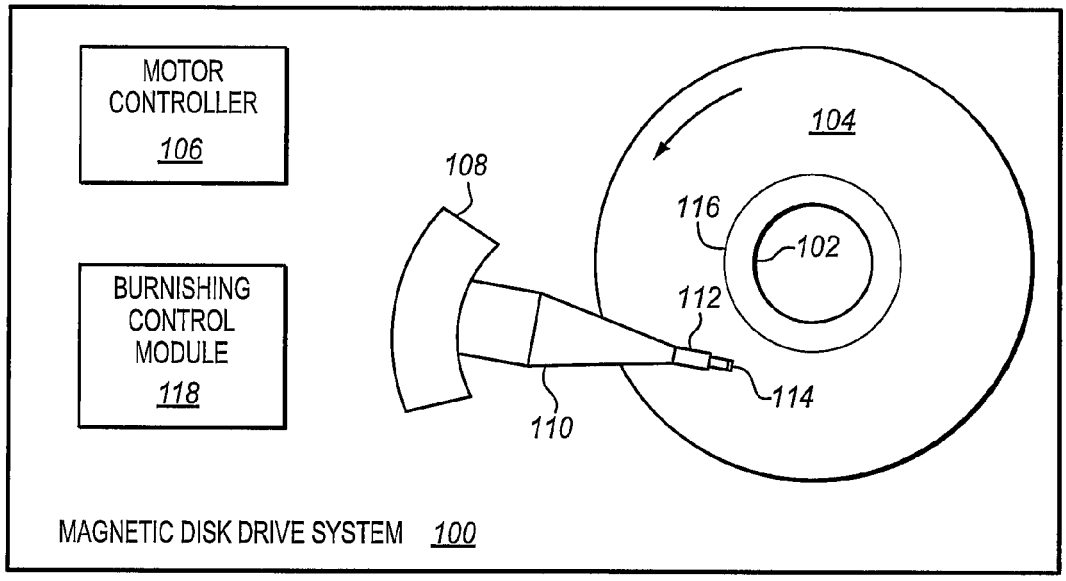
FIG. 1
FIG. 2
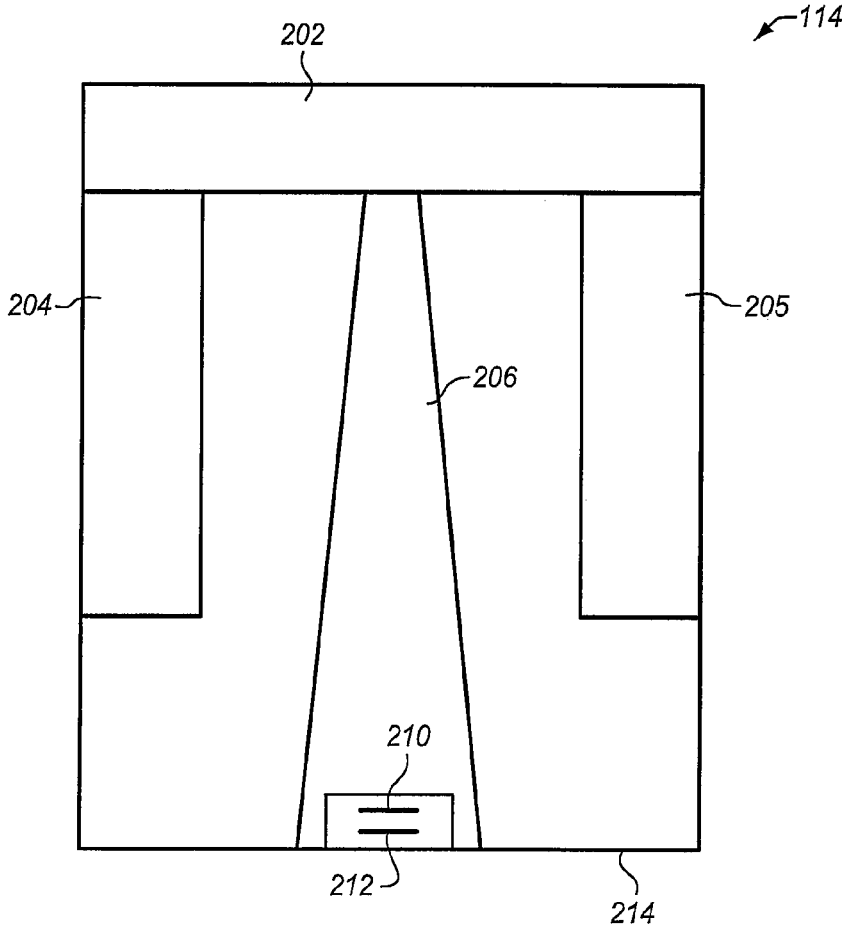

SYSTEMS AND METHODS FOR IN-SITU RECORDING HEAD BURNISHING

BACKGROUND OF THE INVENTION

1. Field of the Invention

The invention is related to the field of magnetic recording disk drive systems and, in particular, to burnishing a recording head to reduce the topography of the recording head.

2. Statement of the Problem

Magnetic hard disk drive systems typically include a magnetic disk, a recording head having write and read elements, a suspension arm, and an actuator arm. As the magnetic recording media is rotated, air adjacent to the disk surface moves with the disk. This allows the recording head (also referred to as a slider) to fly on an extremely thin cushion of air, generally referred to as an air bearing. When the recording head flies on the air bearing, the actuator arm swings the suspension arm to place the recording head over selected circular tracks on the rotating magnetic recording media where signal fields are written to and read by the write and read elements, respectively. The write and read elements are connected to processing circuitry that operates according to a computer program to implement write and read functions.

Recording head flying height is one of the key elements of the density of magnetic recording drives. The closer a recording head flies above the magnetic recording media, the higher density recording that can be utilized. Typically, the recording head and the recording media are each covered with a layer of overcoat material, such as carbon. The thickness of the carbon overcoat region on the head is presently approximately 2 nm, and the thickness of the media overcoat layer is presently approximately 3.8 nm to 4 nm. On top of the disk overcoat layers is a layer of lubricant material, typically 1 nm in thickness. These layers are typically deposited with an uneven topography. Thus, the media and recording head roughness limit how close the recording head can safely fly over the disk with an adequate clearance margin. Further, because of differences in lapping rates during manufacturing, the read sensor is typically recessed from the air-bearing surface (ABS), further increasing the magnetic spacing between the read sensor and the magnetic recording media.

One technique utilized to reduce the recording head roughness and recording head overcoat is to burnish the recording head surface in the region around the read sensor and the write pole in a controlled manner to remove a few nanometers of material, as described in "A novel wear-in-pad approach to minimizing spacing at the head/disk interface", Singh, G. P.; Knigge, B. E.; Payne, R.; Run-Han Wang; Mate, C. M.; Arnett, P. C.; Davis, C.; Nayak, V.; Xiao Wu; Schouterden, K.; Baumgart, P., IEEE Transactions on Magnetics, Volume 40, Issue 4, Part 2, July 2004 Page(s): 3148-3152. The material removed typically comprises the carbon overcoat region of the recording head. Burnishing may be performed in-situ in the magnetic recording disk drive using a burnishing pad fabricated on the magnetic recording media. The recording head is burnished against the burnishing pad in a special process after the assembly of the drive until the recording head can safely clear the surface of the magnetic recording media. However, if the burnishing process proceeds into the read sensor material, then the read back signal is degraded due to thermal and mechanical stress imposed on the read sensor by the burnishing process. Thus, it is a problem for accurately determining when to stop the burnishing process such that wear does not proceed into the read sensor material.

SUMMARY OF THE SOLUTION

Embodiments of the invention solve the above and other related problems with systems and methods for burnishing a recording head in-situ in a magnetic recording disk drive. The burnishing process generates a tribocurrent, which is electricity generated by the rubbing of dissimilar materials. Different materials can exhibit widely different tribocurrent characteristics while in sliding contact. The tribocurrent can thus act as an indicator of the particular materials of the recording head making contact with the magnetic recording media during different stages of the burnishing process.

By identifying the materials contacting the magnetic recording media at any particular stage of the process, the burnishing process may be stopped prior to wearing the material comprising the read element. For example, because the read sensor is often recessed from the ABS, the carbon overcoat layer covering portions of the recording head on the side regions of the read sensor will wear away prior to portions of the carbon overcoat layer covering the read sensor. This will expose material of the recording head (e.g., insulation material) on side regions of the read sensor, causing a change in the tribocurrent generated by the burnishing process: Advantageously, the burnishing process can be stopped prior to wearing the read sensor and affecting its subsequent read back performance.

One embodiment of the invention comprises a method for burnishing a recording head in-situ in a magnetic recording disk drive. The method comprises initiating contact between the recording head and a magnetic recording media of the magnetic recording disk drive and identifying an initial value of a tribocurrent of the recording head during the contact between the recording head and the magnetic recording media. The method further comprises monitoring the tribocurrent to detect a change in the initial value of the tribocurrent indicating that the burnishing has exposed a particular material of the recording head, and stopping the contact between the recording head and the magnetic recording media responsive to determining that the particular material of the recording head is exposed.

A second embodiment of the invention comprises a system for burnishing a recording head. The system comprises a magnetic recording disk drive including a recording head and a magnetic recording media. The system further comprises a burnishing control module adapted to initiate contact between the recording head and the magnetic recording media and adapted to identify an initial value of a tribocurrent of the recording head during the contact between the recording head and the magnetic recording media. The burnishing control module is further adapted to monitor the tribocurrent to detect a change in the initial value of the tribocurrent indicating that the contact has exposed a particular material of the recording head, and adapted to stop the contact between the recording head and the magnetic recording media responsive to determining that the particular material of the recording head is exposed.

Another embodiment of the invention comprises another method for burnishing a recording head in-situ in a magnetic recording disk drive. The method comprises burnishing the recording head against a magnetic recording media of the magnetic recording disk drive and monitoring a tribocurrent in the recording head generated by the burnishing to determine whether the tribocurrent has reached a threshold value. The method further comprises stopping the burnishing responsive to determining that the tribocurrent has reached the threshold value.

The invention may include other exemplary embodiments described below.

DESCRIPTION OF THE DRAWINGS

The same reference number represents the same element or same type of element on all drawings.

FIG. 1 illustrates a magnetic recording disk drive in an exemplary embodiment of the invention.

FIG. 2 illustrates the recording head of FIG. 1 in an exemplary embodiment of the invention.

DETAILED DESCRIPTION OF THE INVENTION

Figure 3:
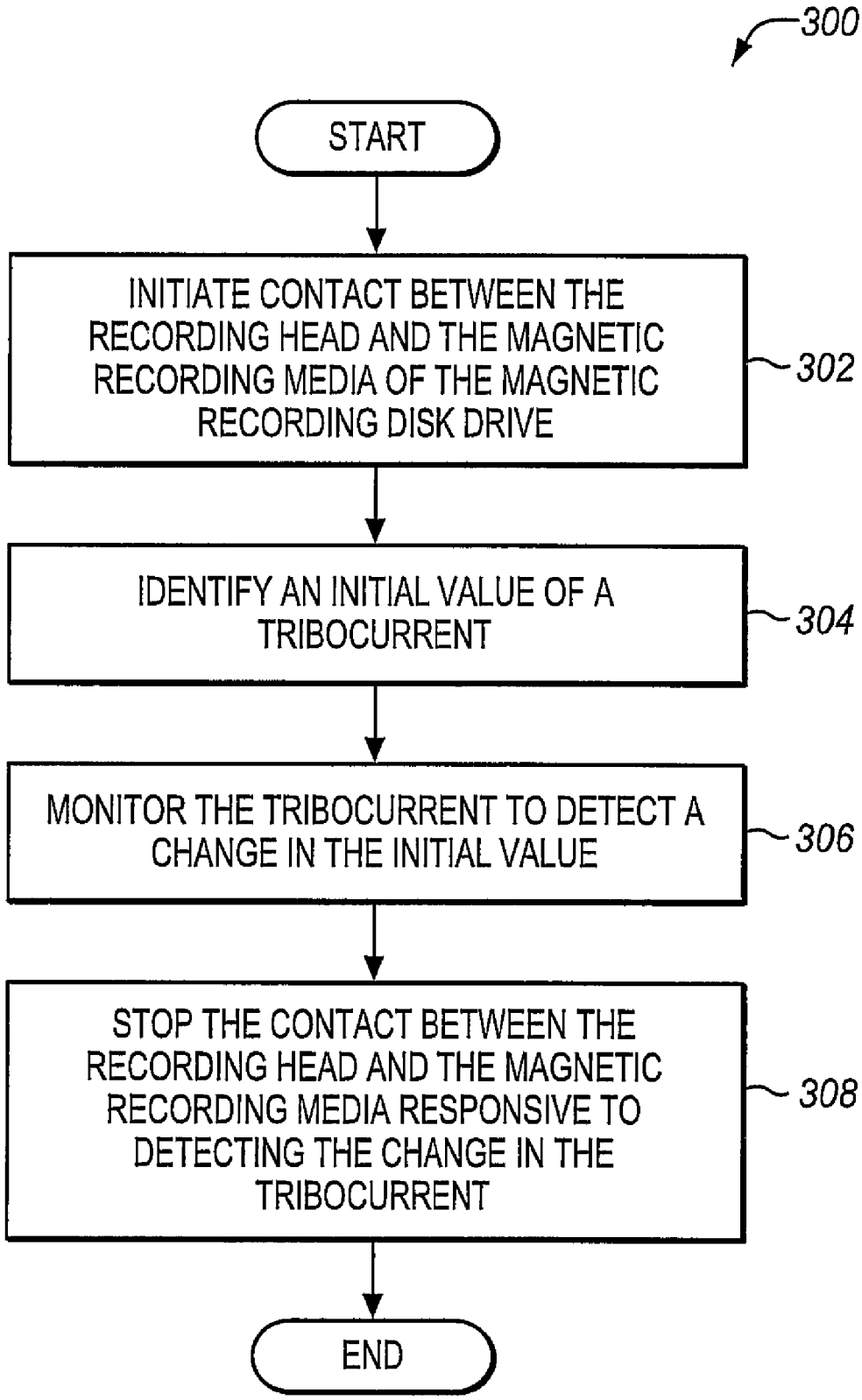
FIG. 3 illustrates a flow chart of a method for burnishing a recording head in-situ in a magnetic recording disk drive in an exemplary embodiment of the invention.

FIGS. 1-9 and the following description depict specific exemplary embodiments of the invention to teach those skilled in the art how to make and use the invention. For the purpose of teaching inventive principles, some conventional aspects of the invention have been simplified or omitted. Those skilled in the art will appreciate variations from these embodiments that fall within the scope of the invention. Those skilled in the art will appreciate that the features described below can be combined in various ways to form multiple variations of the invention. As a result, the invention is not limited to the specific embodiments described below, but only by the claims and their equivalents.

FIG. 1 illustrates a magnetic recording disk drive 100 in an exemplary embodiment of the invention. Magnetic recording disk drive 100 includes a spindle 102, a magnetic recording media 104, a motor controller 106, an actuator 108, an actuator arm 110, a suspension arm 112, and a recording head 114. Spindle 102 supports and rotates a magnetic recording media 104 in the direction indicated by the arrow. A spindle motor (not shown) rotates spindle 102 according to control signals from motor controller 106. Recording head 114 is supported by suspension arm 112 and actuator arm 110. Actuator arm 110 is connected to actuator 108 that is configured to rotate in order to position recording head 114 over a desired track of magnetic recording media 104.

When magnetic recording media 104 rotates, air generated by the rotation of magnetic recording media 104 causes an air bearing surface (ABS) of recording head 114 to ride on a cushion of air a particular height above magnetic recording media 104. The height depends on the shape of the ABS. As recording head 114 rides on the cushion of air, actuator 108 moves actuator arm 110 to position a read element (not shown) and a write element (not shown) in recording head 114 over selected tracks of magnetic recording media 104.

Magnetic recording media 104 may optionally comprise a burnishing pad 116, which comprises one or more tracks of magnetic recording media 104. Recording head 114 may make contact with a surface of magnetic recording media 104 (or burnishing pad 116) to polish the surface of recording head 114 and reduce the topography of recording head 114. Magnetic recording disk drive 100 further comprises a burnishing control module 118. Burnishing control module 118 controls and monitors an in-situ burnishing process of magnetic recording disk drive 100. Burnishing control module 118 may be electrically coupled to suspension arm 112 or elements of recording head 114 (e.g., a read sensor or write pole) to monitor a tribocurrent generated by the burnishing process.

While burnishing control module 118 is illustrated within magnetic recording disk drive 100, it will be appreciated that burnishing control module 118 may be implemented as a device external to magnetic recording disk drive 100. Thus, suspension arm 112 or recording head 114 may be electrically coupled to an output line (not shown) that carries a tribocurrent signal to an external burnishing control module for monitoring of the burnishing process. Magnetic recording disk drive 100 may include other devices, components, or systems not shown in FIG. 1. For instance, a plurality of magnetic disks, actuators, actuator arms, suspension arms, and recording heads may be used.

FIG. 2 illustrates recording head 114 in an exemplary embodiment of the invention. The view of recording head 114 is of the ABS side of recording head 114. Recording head 114 has a cross rail 202, two side rails 204-205, and a center rail 206 on the ABS side. The rails on recording head 114 illustrate just one embodiment, and the configuration of the ABS side of recording head 114 may take on any desired form. Recording head 114 also includes a write element 210 and a read sensor 212 on a trailing edge 214 of recording head 114.

FIG. 3 illustrates a flow chart of a method 300 for burnishing a recording head in-situ in a magnetic recording disk drive in an exemplary embodiment of the invention. The steps of method 300 will be discussed in reference to magnetic recording disk drive 100 of FIGS. 1-2 and 4-7. The steps of method 300 are not all inclusive, and may include other steps now shown for the sake of brevity.

Figure 4:
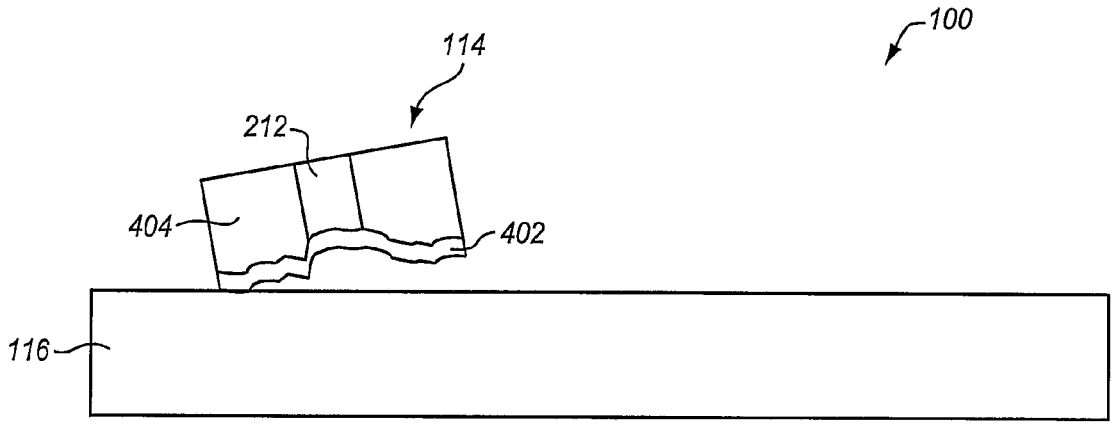
FIG. 4 illustrates the recording head of FIG. 1 during initiation of the burnishing process in an exemplary embodiment of the invention.

In step 302, burnishing control module 118 initiates contact between recording head 114 (see FIG. 1) and magnetic recording media 104 of magnetic recording disk drive 100. Particularly, recording head 114 may make direct contact with a recordable surface of magnetic recording media 118. Alternatively, contact may be initiated between recording head 114 and a burnishing pad 116 of magnetic recording media 104. FIG. 4 illustrates recording head 114 of FIG. 1 during initiation of the burnishing process in an exemplary embodiment of the invention. Contact is initiated by positioning recording head 114 over magnetic recording media 104, and adjusting a height of recording head 114 such that a bottom surface of recording head 114 becomes engaged with a surface of magnetic recording media 104. Initially, an overcoat layer structure 402 (see FIG. 4) will make contact with magnetic recording media 104 and will begin to wear away.

In step 304, burnishing control module 118 (see FIG. 1) identifies an initial value of a tribocurrent of recording head 114 during contact between recording head 114 and magnetic recording media 104. As recording head 114 makes contact with magnetic recording media 104 (or burnishing pad 116), a tribocurrent is generated which flows through recording head 114. The initial value of the tribocurrent identifies the initial layer of material being burnished (e.g., overcoat layer structure 402 (see FIG. 4)). For example, overcoat layer structure 402 may comprise a carbon material. When overcoat layer structure 402 is worn away on portions of recording head 114, another layer of material (e.g., insulation material 404) will be exposed to magnetic recording media 104. For example, insulation material 404 may comprise alumina. Because insulation material 404 is a different material than overcoat layer structure 402, insulation material 404 will generate a different tribocurrent while in contact with magnetic recording media 116, and thus, the transition between burnishing of overcoat layer structure 402 and insulation material 404 can be identified.

Overcoat layer structure 402 may also comprise multiple layers, such as a carbon overcoat layer and a silicon adhesion layer. Wearing of the silicon adhesion layer generates a different tribocurrent than wearing of the carbon layer. Thus, the transition between wearing of the silicon and wearing of the carbon can be identified based on the generated tribocurrent. Overcoat layer structure 402 may additionally comprise other layers, such as an overcoat material that has a very characteristic tribocurrent (e.g., very high with respect to the carbon overcoat layer) that is much easier to detect than the typical overcoat layers (e.g., silicon and carbon). On exemplary overcoat material with this characteristic includes glass.

Figure 5:
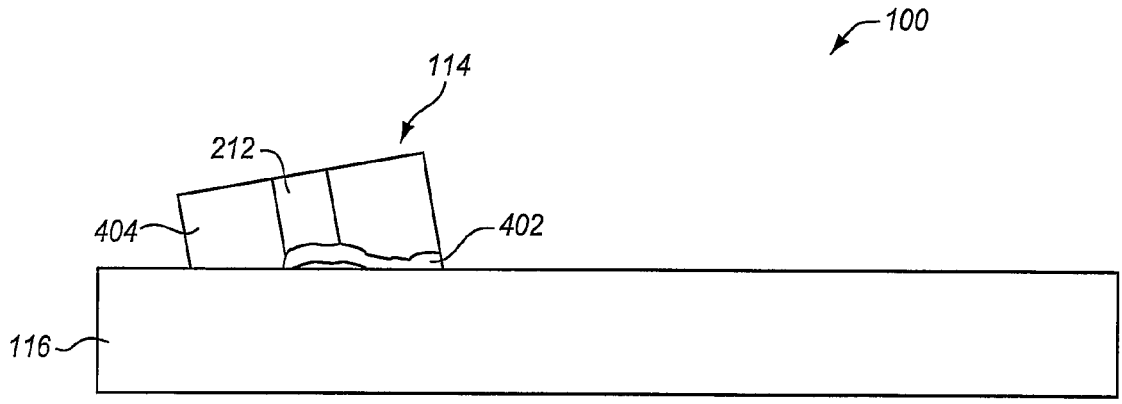
FIG. 5 illustrates a magnetic recording disk drive after burnishing has exposed insulation material in an exemplary embodiment of the invention.

In step 306, burnishing control module 118 (see FIG. 1) monitors the tribocurrent to detect a change in the initial value of the tribocurrent. This change in the tribocurrent indicates that the burnishing has exposed a particular material of recording head 114. In this case, burnishing has exposed insulation material 404 on side regions of read sensor 212. FIG. 5 illustrates magnetic recording disk drive 100 after burnishing has exposed insulation material 404 in an exemplary embodiment of the invention.

In step 308, burnishing control module 118 (see FIG. 1) stops contact between recording head 114 (see FIG. 1) and magnetic recording media 104 responsive to determining that a particular material (e.g., insulation material 404 of FIG. 4) of recording head 114 is exposed. Burnishing control module 118 may instruct motor controller 106 to raise a height of recording head 114 so that recording head 114 is not contacting magnetic recording media 104. Based on the change in the tribocurrent, burnishing control module 118 stops the burnishing process when insulation material 404 is exposed. Because read sensor 212 is recessed from an ABS of recording head 114, portions of carbon overcoat layer structure 402 will remain over read sensor 212.

Alternatively, the burnishing process may be stopped when a silicon adhesion layer of overcoat layer structure 402 is exposed or removed by burnishing. If a special high tribocurrent material is utilized in overcoat layer structure 402, then the burnishing process may be stopped once this material is exposed or removed by burnishing.

Figure 6:
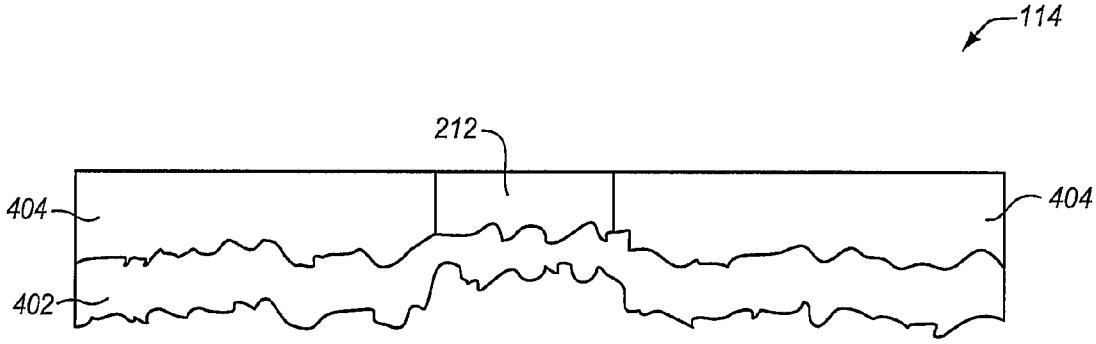
FIG. 6 illustrates a side view of the recording head of FIG. 1 prior to the burnishing process in an exemplary embodiment of the invention.
Figure 7:
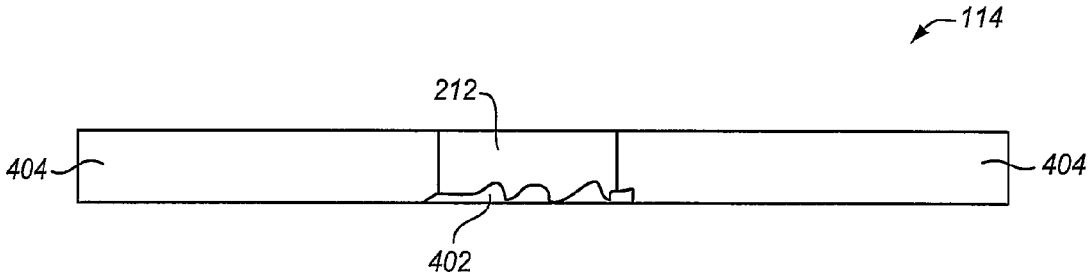
FIG. 7 illustrates a side view of the recording head of FIG. 1 after completion of the method of FIG. 3 in an exemplary embodiment of the invention.

FIG. 6 illustrates a side view of recording head 114 of FIG. 1 prior to the burnishing process in an exemplary embodiment of the invention. FIG. 7 illustrates a side view of recording head 114 of FIG. 1 after completion of step 306 (see FIG. 3) in an exemplary embodiment of the invention. There is a height difference due to the removal of portions of carbon overcoat layer structure 402. Because of the lower clearance, recording head 114 can fly at a lower height over magnetic recording media 104. Thus, read sensor 212 is closer to magnetic recording media 104 for reading data recorded on magnetic recording media 104. Additionally, because there is a small amount of carbon overcoat layer structure 402 remaining on read sensor 212, read sensor 212 is not actually worn by the burnishing process. Advantageously, the burnishing process of FIG. 3 decreases the magnetic spacing of recording head 114 (i.e., the distance between read sensor 212 and magnetic recording media 104) without wearing read sensor 212. Thus, the burnishing process does not negatively impact the subsequent performance of read sensor 212.

There are different techniques for monitoring a tribocurrent to determine when to stop a burnishing process. Once such process determines whether the tribocurrent crosses a specified threshold value. The threshold value indicates a change in the material wearing against magnetic recording media 104 (see FIG. 1).

Figure 8:
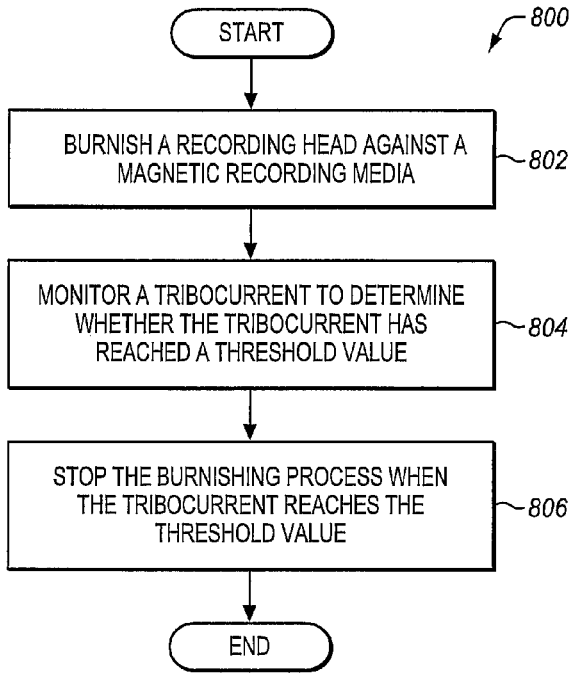
FIG. 8 illustrates a flow chart of another method for burnishing a recording head in-situ in a magnetic recording disk drive in an exemplary embodiment of the invention.

FIG. 8 illustrates a flow chart of another method 800 for burnishing a recording head in-situ in a magnetic recording disk drive in an exemplary embodiment of the invention. The steps of method 800 will be discussed in reference to magnetic recording disk drive 100 of FIGS. 1-2 and 4-5. The steps of method 800 are not all inclusive, and may include other steps now shown for the sake of brevity.

In step 802 (see FIG. 8), burnishing control module 118 (see FIG. 1) burnishes recording head 114 against magnetic recording media 104. The burnishing process may be initiated as described in step 302 of FIG. 3.

In step 804 (see FIG. 8), burnishing control module 118 monitors a tribocurrent in the recording head generated by the burnishing process to determine whether the tribocurrent has reached a threshold value. The threshold value may define a particular tribocurrent occurring when a specific type of material is contacting magnetic recording media 104.

Figure 9:
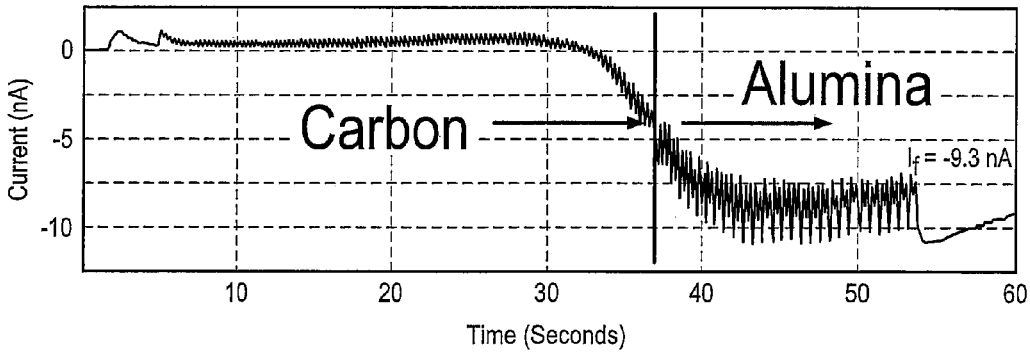
FIG. 9 illustrates a graph of a tribocurrent measured during a burnishing process in an exemplary embodiment of the invention.

FIG. 9 illustrates a graph of a tribocurrent measured during a burnishing process in an exemplary embodiment of the invention. The tribocurrent has a relatively steady value from 0 seconds to 30 seconds. At approximately 30 seconds, the tribocurrent begins to decrease significantly. Because most of carbon overcoat layer structure 402 (see FIG. 4) has worn away from the surface of recording head 114, the tribocurrent shows a change in polarity and a significant decrease at the transition point when insulation material 404 begins to wear against magnetic recording media 104 instead of carbon overcoat layer structure 402. Thus, the change in polarity and the sharp decrease in the tribocurrent represent an indication that burnishing has removed carbon overcoat layer structure 402 (see FIG. 4) and exposed insulation material 404.

In step 806 (see FIG. 8), burnishing control module 118 (see FIG. 1) stops the burnishing process responsive to determining that the tribocurrent has reached the threshold value. For example, burnishing control module 118 may stop the burnishing process when the tribocurrent falls below a threshold of −3 nA (representing the transition between burnishing of carbon overcoat layer structure 402 (see FIG. 4) and insulation material 404). Further burnishing past the selected threshold may completely remove carbon overcoat layer structure 402, thus exposing read sensor 212 to wear against magnetic recording media 104. Thus, the threshold value of the tribocurrent may represent a burnishing threshold in which additional burnishing may damage read sensor 212 (see FIG. 2).

In one embodiment, identification of the threshold may comprise monitoring a derivative of the tribocurrent (e.g., a first derivative). When the first derivative of the tribocurrent is zero, a maximum or minimum of the tribocurrent occurs at that particular value. It is typical for a tribocurrent to reach a maximum or minimum value during the burnishing process near the transition point between materials. This maximum or minimum value can thus be used as an indicator of the transition point between two materials of recording head 114 (see FIG. 1) making contact with magnetic recording media 104.

Referring back to FIG. 9, the tribocurrent begins to rise between 20 and 30 seconds, reaching a maximum before trailing off and changing polarity. By monitoring the first derivative of the tribocurrent, burnishing control module 118 determines when a maximum value of the tribocurrent occurs. This maximum value of the tribocurrent is one indication that carbon overcoat layer structure 402 (see FIG. 4) on side regions of read sensor 212 will soon be worn away exposing insulation material 404. Thus, if it is desirable to stop the burnishing process while carbon overcoat layer structure 402 remains across the surface of recording head 114, then the burnishing process may be stopped at this maximum or minimum value of the value of the tribocurrent.

Although specific embodiments were described herein, the scope of the invention is not limited to those specific embodiments. The scope of the invention is defined by the following claims and any equivalents thereof.

We claim:

1. A method for burnishing a recording head in-situ in a magnetic recording disk drive, the method comprising:

initiating contact between the recording head and a magnetic recording media of the magnetic recording disk drive;

identifying an initial value of a tribocurrent of the recording head during the contact between the recording head and the magnetic recording media;

monitoring the tribocurrent to detect a change in the initial value of the tribocurrent indicating that the contact has exposed a particular material of the recording head; and stopping the contact between the recording head and the magnetic recording media responsive to determining that the particular material of the recording head is exposed.

2. The method of claim 1, wherein monitoring the tribocurrent to detect the change in the initial value comprises:

identifying a second value of the tribocurrent that has reached a threshold value.

3. The method of claim 1, wherein monitoring the tribocurrent to detect the change in the initial value comprises:

identifying a change in polarity of the tribocurrent from the initial value.

4. The method of claim 1, wherein monitoring the tribocurrent to detect the change in the initial value comprises:

identifying that a derivative of the tribocurrent is zero indicating that the tribocurrent has reached a maximum or minimum value.

5. The method of claim 1, wherein the particular material exposed by the burnishing comprises insulation material on side regions of a read sensor of the recording head.

6. The method of claim 1, wherein monitoring the tribocurrent to detect the change in the initial value comprises:

identifying that a second value of the tribocurrent indicates that the burnishing has removed a carbon overcoat layer of the recording head.

7. The method of claim 1, wherein monitoring the tribocurrent to detect the change in the initial value comprises:

identifying that a second value of the tribocurrent indicates that the burnishing has exposed a silicon layer utilized for adhesion of a carbon overcoat layer of the recording head.

8. A system for burnishing a recording head, the system comprising:

a magnetic recording disk drive including a recording head; and a burnishing control module in signal communication with the recording head and adapted to:

initiate contact between the recording head and the magnetic recording media of the magnetic recording disk drive;

identify an initial value of a tribocurrent of the recording head during the contact between the recording head and the magnetic recording media;

monitor the tribocurrent to detect a change in the initial value of the tribocurrent indicating that the contact has exposed a particular material of the recording head; and stop the contact between the recording head and the magnetic recording media responsive to determining that the particular material of the recording head is exposed.

9. The system of claim 8, wherein the burnishing control module is further adapted to:

identify a second value of the tribocurrent that has reached a threshold value.

10. The system of claim 8, wherein the burnishing control module is further adapted to:

identify a change in polarity of the tribocurrent from the initial value.

11. The system of claim 8, wherein the burnishing control module is further adapted to:

identify that a derivative of the tribocurrent is zero indicating that the tribocurrent has reached a maximum or minimum value.

12. The system of claim 8, wherein the particular material exposed by the burnishing comprises insulation material on side regions of a read sensor of the recording head.

13. The system of claim 8, wherein the burnishing control module is further adapted to:

identify that a second value of the tribocurrent indicates that the burnishing has removed a carbon overcoat layer of the recording head.

14. The system of claim 8, wherein the burnishing control module is further adapted to:

identify that a second value of the tribocurrent indicates that the burnishing has exposed a silicon layer utilized for adhesion of a carbon overcoat layer of the recording head.

15. The system of claim 8, wherein the burnishing control module is electrically coupled to a suspension arm of the recording head to identify values of the tribocurrent.

16. The system of claim 8, wherein the burnishing control module is electrically coupled to a read sensor of the recording head to identify values of the tribocurrent.

17. The system of claim 8, wherein the burnishing control module is electrically coupled to a write pole of the recording head to identify values of the tribocurrent.

18. The system of claim 8, wherein:

the recording head comprises an overcoat layer structure including a carbon layer, and an overcoat material selected to generate a tribocurrent greater than the carbon layer when in contact with the magnetic recording media; and the burnishing control module is further adapted to identify that a second value of the tribocurrent indicates that the burnishing has exposed the overcoat material of the recording head.

19. A method for burnishing a recording head in-situ in a magnetic recording disk drive, the method comprising:

burnishing the recording head against a magnetic recording media of the magnetic recording disk drive;

monitoring a tribocurrent in the recording head generated by the burnishing to determine whether the tribocurrent has reached a threshold value; and stopping the burnishing responsive to determining that the tribocurrent has reached the threshold value.

20. The method of claim 19, wherein the threshold value comprises a change in polarity of the tribocurrent.

21. The method of claim 19, wherein determining whether the tribocurrent has reached the threshold value further comprises:

computing a derivative of the tribocurrent;

identifying a maximum or minimum value of the tribocurrent based on the derivative; and identifying the threshold value based on the maximum or the minimum value.

* * * * *